United States Patent [19]

Koppen et al.

[11] Patent Number: 4,483,538

[45] Date of Patent: Nov. 20, 1984

[54] TAMPERPROOF REUSABLE BINGO CARD

[75] Inventors: Earl L. Koppen, Apt. 333, 13823 - 12th SW., Seattle, Wash. 98166; Douglas E. Winters, Bothell, Wash.

[73] Assignee: Earl L. Koppen, Seattle, Wash.

[21] Appl. No.: 475,440

[22] Filed: Mar. 15, 1983

[51] Int. Cl.[3] ..... A63F 3/06

[52] U.S. Cl. ..... 273/270

[58] Field of Search ..... 273/157 A, 269, 270, 273/271, 272, 273, 281; 40/491; 116/324

[56] References Cited

U.S. PATENT DOCUMENTS 857,590 6/1907 Branch ..... 116/324

2,192,825 3/1940 Carney ..... 273/270

2,491,257 12/1949 Fawkes ..... 273/270 X 3,383,112 5/1968 Crozier ..... 273/270

3,663,020 5/1972 Moore ..... 273/270

*Primary Examiner*—Harland S. Skogquist

*Attorney, Agent, or Firm*—Ward Brown; Robert W. Beach

[57] ABSTRACT

A translucent intermediate sheet having a standard array of bingo numbers is sandwiched between transparent top and bottom sheets. Alterations to the card, such as by a cheater, to permit changing, adding or rearranging bingo numbers can be seen through the sheets.

12 Claims, 7 Drawing Figures

Fig. 1
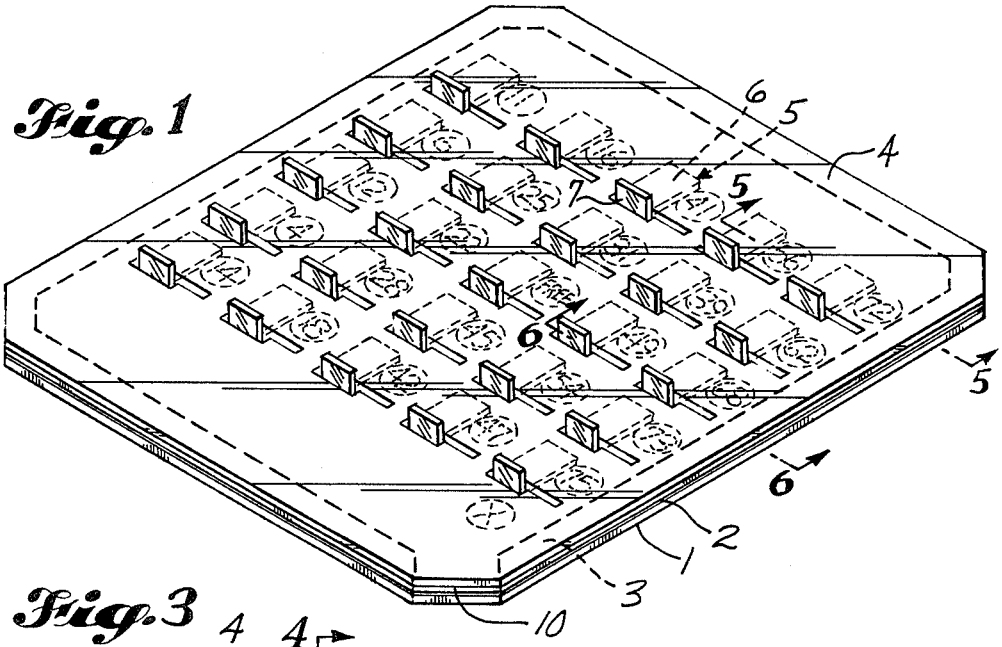
Fig. 3
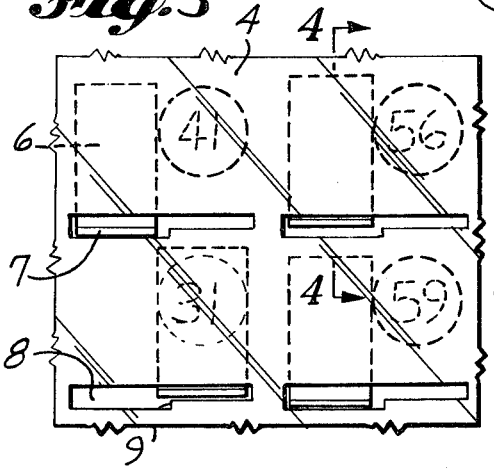
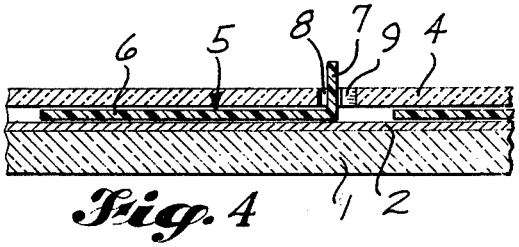
Fig. 4
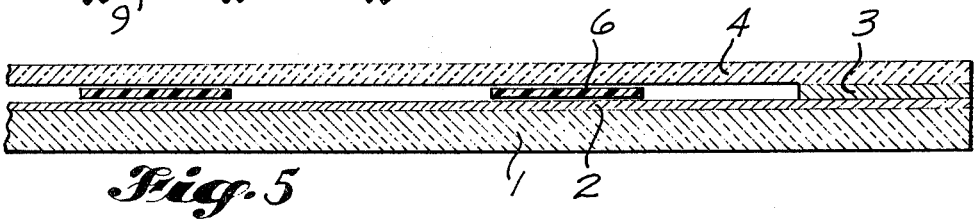
Fig. 5
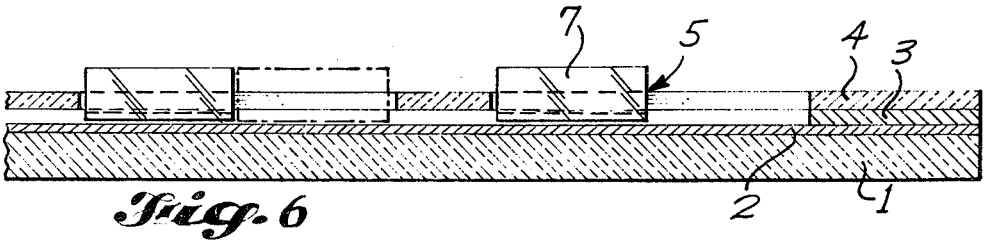
Fig. 6

TAMPERPROOF REUSABLE BINGO CARD

BACKGROUND OF THE INVENTION

1. Field of the Invention

This invention relates generally to game boards or cards used in playing the game of bingo.

2. Prior Art

In known reusable bingo cards of the type commonly used by commercial bingo parlors, a paper number sheet having the rectangular array of 24 numbers and the central "free" space is sandwiched between top and bottom cardboard sheets. The margins of the cardboard sheets are sewn together with string or heavy thread.

The numbers printed on the paper sheet are viewed through windows in the top sheet. When desired, any of the numbers can be covered by a separate, substantially transparent, red plastic slide by manipulation of a short upstanding leg extending out from the main body of the slide. Such leg projects through a transverse slot in the top sheet generally below the window for the number to be covered.

As evidenced by the newspaper article titled "Officers got their number; 3 bingo cheats collared" by Dee Norton, appearing in the Oct. 30, 1982 edition of The Seattle Times on page A-7, bingo games with valuable prizes have attracted cheaters who steal bingo cards, alter them and then return to the game hall or parlor to use the altered cards. As indicated in the article, substantial sums have been paid out to cheaters using such altered bingo cards. In the system described in the newspaper article, a stolen card is sliced open along an edge and a small paper disc having several printed numbers is inserted between the top sheet and number sheet so that any of the several numbers on the disc can be made to appear in one of the windows. The altered cards are then restitched so that they appear identical to the original cards.

The problem of cheating by altering the reusable cards has led to the use of throwaway, manually marked paper bingo sheets, at least for the games having the most valuable prizes.

SUMMARY OF THE INVENTION

A principal object of the present invention is to provide a tamperproof, reusable bingo card which eliminates or greatly lessens the prospects that the card can be altered and used by a cheater without detection of the alteration.

A further object is to provide such a bingo card which is of simple, inexpensive construction, yet durable and easy to use and repair.

The foregoing objects can be accomplished by providing a composite bingo card including a plurality of stacked sheets secured together and having an array of bingo numbers, each of these sheets being light-transmitting material. In a preferred embodiment, the sheets include a substantially transparent plastic bottom sheet, a substantially transparent plastic top sheet secured over the bottom sheet and a separate intermediate sheet of thin translucent material secured between the top and bottom sheets and upon which the bingo numbers are printed. The bingo numbers can be viewed through the substantially transparent material of the top sheet, and alterations to the card are readily viewable through the top or bottom sheets.

A narrow peripheral shim can be provided to space apart the top sheet and the number sheet, leaving a space for several substantially transparent but colored slides each movable between a position covering one of the bingo numbers and a position uncovering such number. The slides include upward projecting legs extending through transverse slots in the top sheet. The slots can be contoured to have a shoulder abuttable against an edge of the upward projecting leg of the associated slide in its number-uncovering position so that positive action of the bingo player is required to move the slide to its number-covering position. The shim can have an opening communicating between the exterior of the card and its internal slide-receiving cavity so that a broken slide can be removed. A new slide can be inserted through the appropriate transverse slot in the top sheet of the card.

In an alternative embodiment, the top sheet of the card is substantially transparent but of a color the same as the color of the slides, and the bingo numbers printed on the intermediate number sheet are viewed through window holes in the colored top sheet. In this embodiment, preferably the intermediate number sheet is of a color different than the top sheet and the slides so that uncovered numbers are highlighted by the different background color of the number sheet. A thin, substantially transparent, clear plastic sheet can be interposed between the top sheet and the number sheet to prevent access to the number sheet through the window holes.

BRIEF DESCRIPTION OF THE DRAWINGS

FIG. 1 is a top perspective of a bingo card in accordance with the present invention.

FIG. 3 is an enlarged fragmentary plan of the bingo card of FIG. 1.

FIG. 4 is a section taken along line 4—4 of FIG. 3.

FIG. 5 is a section taken along line 5—5 of FIG. 1.

FIG. 6 is a somewhat diagrammatic section taken along line 6—6 of FIG. 1.

DETAILED DESCRIPTION

Figure 2:
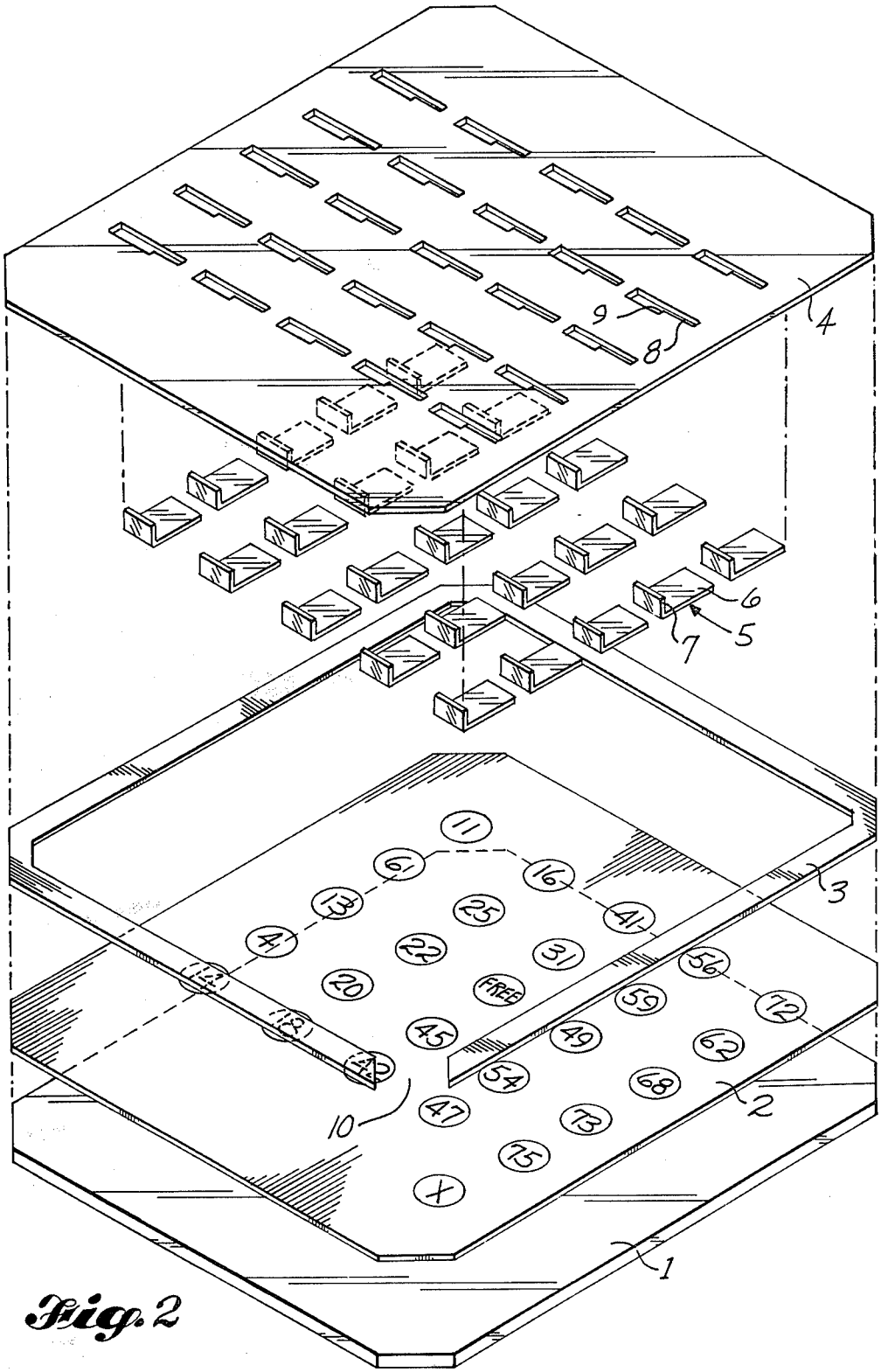
FIG. 2 is an exploded top perspective of the bingo card of FIG. 1.

The composite bingo card of the present invention shown in FIGS. 1 and 2 is designed to deter tampering such as described in The Seattle Times article mentioned previously. The card is a laminate including a backing or bottom sheet 1, a number sheet 2, a narrow peripheral shim 3 and a top sheet 4. Each of the sheets is light-transmitting material. Preferably the top and bottom sheets are clear, substantially transparent, hard and tough plastic. The number sheet can be thin, white, translucent paper having the bingo numbers printed on it in the conventional rectangular array along with an identifying serial number which is represented by the "X" shown toward the bottom of the card. Each number is highlighted by an enclosing brightly colored, preferably red, circle. The sheets and the shim are secured together by hard, permanent adhesive or cement.

The narrow shim 3 interposed between the number sheet 2 and top sheet 4 extends along the margins of the sheets and provides a space within which individual, substantially transparent but brightly colored slides 5 may be moved without binding to cover or uncover the bingo numbers. As best seen in FIG. 4, each slide is of L cross section and has its longer leg or planar sliding portion 6 interposed between the top sheet and the number sheet. The shorter leg 7 of the slide projects upward through a transverse slot 8 in the top sheet 4. The width of the slide is sufficient to cover its number printed on the number sheet. The length of each slot 8 is approximately twice the width of a slide. Each slide can be moved manually by manipulation of its upward projecting shorter leg between one position in which its longer leg 6 covers its number and another position in which the longer leg extends alongside the number without covering it, as seen in FIGS. 3 and 6.

As best seen in FIG. 3, the transverse slots 8 through the top sheet 4 are not of uniform width. The portion of each slot 8 corresponding to the number-covering position of its associated slide is only slightly wider than the thickness of the upward projecting slide leg 7, whereas the remainder of the slot is substantially wider forming a shoulder 9 allowing the slide to be shifted lengthwise, downward as viewed in FIG. 3, to the position indicated for the slides for the numbers "41" and "59". To move the slide to its number-covering position, it first would be shifted upward as viewed in FIG. 3 to the position of the slide for the number "56", then transversely of its length to the position indicated for the number "31". All of the slides can be moved together back to their initial "starting" positions, such as at the end of a bingo game, by tapping the card against its left edge then against its bottom edge. The possibility of any slide being inadvertently moved to its number-covering position is small because of the positive action required of first moving a slide lengthwise so that its shorter upward projecting leg is in registration with the narrow portion of its slot.

It is intended that the bingo card of the present invention be used repeatedly over a long period of time. Consequently, one or more of the slides 5 may be broken, such as if the slides are of a material that becomes brittle as it ages or if the card is subjected to hard, abusive use. The construction of the card of the present invention allows easy replacement of broken slides. Any remaining portion of the short, upward-projecting leg 7 of a broken slide can be cut from the longer leg 6 and pulled out from the associated transverse slot 8. For removal of the long leg 6 of the slide interposed between the top sheet 4 and the number sheet 2, it will be noted that the narrow peripheral shim 3 is not a complete ring encircling the number array but rather has an opening 10 which, in the embodiment of the invention shown in FIGS. 1 through 6, is located at a lower corner of the composite card. The remaining longer leg 6 can be shifted downward and slid out the shim opening 10 by shaking the card in upright position or tapping its bottom edge and/or its side edges against a hard surface.

Preferably the slides are of at least somewhat flexible material so that the tip of the long leg of a new slide can be inserted through the appropriate transverse slot 8 through the top sheet 4 with the long leg being flexed as it is pushed lengthwise through the slot. In this regard, the wider end portion of the slot allows sufficient room for easy insertion and manipulation of the long leg of the new slide.

The construction of the card of the present invention makes it extremely difficult to alter the card for the purpose of cheating a commercial bingo parlor. There are no windows through the top sheet 4 that would allow access to the paper number sheet 2 for the purpose of altering the numbers printed on such sheet. Cutting or drilling through a stolen card would be difficult and easily detectable because of the substantially transparent hard and tough plastic material used for the top and bottom sheets. Gaining access to the interior of the card through one of its edges is also difficult because the sheets are secured together by hard, permanent adhesive or cement.

Nevertheless, if a cheater is successful in altering a stolen card or constructing a bogus card of a type allowing numbers to be changed or interchanged, such an alteration or construction can be detected easily because all of the sheets are light-transmitting material. It is suggested that each winning card be held up to a light upon completion of the bingo game, whereupon any additional numbers or number-altering or repositioning mechanism would be readily apparent.

Figure 7:
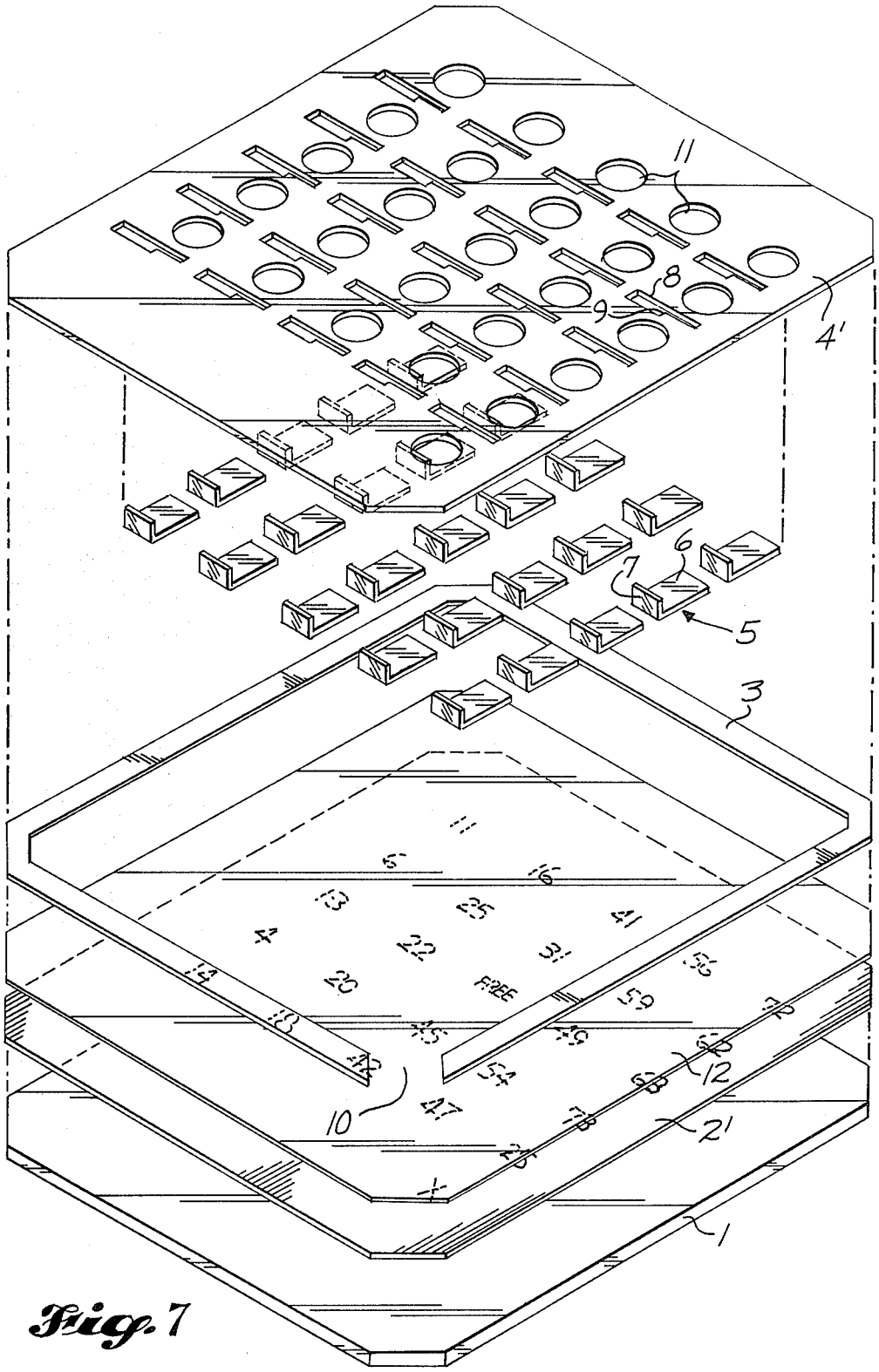
FIG. 7 is an exploded top perspective of another embodiment of a bingo card in accordance with the present invention.

The construction of the second embodiment of the present invention shown in FIG. 7 is very similar to the construction of the previously described embodiment. The backing or bottom sheet 1, peripheral shim 3 and slides 5 of the embodiment of FIG. 7 are as previously described; the slots 8 through the modified top sheet 4' also are as previously described; and the only change in the modified number sheet 2' is that the bingo numbers are not highlighted by enclosing circles.

In the embodiment of FIG. 7, however, the modified top sheet 4', though still substantially transparent, hard and tough plastic material, preferably is of the same color as the slides. In addition, circular window holes 11 are provided through the modified top sheet 4' for the bingo numbers and the card serial number printed on the number sheet. Access to the number sheet through the window holes is prevented by an additional clear, transparent sheet 12, preferably of tough plastic material, covering the number sheet and having its margins interposed between the number sheet and the peripheral shim 3. As in the previously described embodiment, all of the sheets and the shim are secured together by hard, permanent adhesive or cement.

By matching the color of the modified top sheet 4' and the slides 5, the slides are unobtrusive—in fact, almost invisible—when in their starting positions. Any uncovered numbers viewed through the window holes 11 are surrounded by the different, preferably white, background color of the number sheet 2'. The array of uncovered numbers on a white background also emphasizes the positions of those numbers covered by their slides. Such covered numbers still can be viewed through the colored but substantially transparent long legs of the slides.

Altering of a bingo card in accordance with FIG. 7 is as difficult as altering of the previously described embodiment. Since the sheets and the slides still are light-transmitting material, any such alteration should be as easily detected.

The present invention allows the use of reusable bingo cards even for the games having the most valuable prizes which eliminates the cost and inconvenience of using disposable paper bingo sheets. Any additional expense at the time of purchase of the cards is offset by their long life and ease of repair.

We claim:

1. A tamperproof reusable bingo card comprising a plurality of stacked sheets secured together and having an array of bingo numbers, each of said sheets being light-transmitting material such that light can be passed through the entire thickness of the card.

2. The bingo card defined in claim 1, in which the sheets include a top sheet and a bottom sheet of hard and tough plastic material, at least one of said top and bottom sheets being substantially transparent.

3. The bingo card defined in claim 2, in which the sheets include an intermediate sheet of thin translucent material upon which the bingo numbers are printed.

4. The bingo card defined in claim 2, including a peripheral shim secured between the top sheet and the bottom sheet for spacing such sheets apart, and several slides of substantially transparent but colored material each having a portion received between the top and bottom sheets and movable between a position covering a bingo number and a position uncovering such number, such shim having an opening communicating between the exterior of the card and the interior space between the top sheet and the bottom sheet enabling a broken slide to be removed from the interior of the card.

5. The bingo card defined in claim 1, in which the sheets include a bottom sheet, a top sheet secured over the bottom sheet and a separate intermediate sheet secured between said top and bottom sheets and upon which the bingo numbers are printed.

6. The bingo card defined in claim 5, in which the top sheet is substantially transparent and covers the numbers printed on the intermediate sheet such that such numbers are viewed by looking through the material of the top sheet.

7. The bingo card defined in claim 5, in which the top sheet is colored but substantially transparent.

8. The bingo card defined in claim 7, in which the top sheet has window holes through which the bingo numbers can be viewed.

9. The bingo card defined in claim 8, in which the top sheet is of a different color than the color of the intermediate sheet.

10. A tamperproof reusable bingo card comprising a plurality of stacked sheets secured together and having an array of bingo numbers, several separate slides of substantially transparent but colored material and each movable between a position covering one of the bingo numbers and a position uncovering such number, said sheets including a top sheet of substantially transparent material of a color the same as the color of the slides and having window holes through which the bingo numbers can be viewed.

11. The bingo card defined in claim 10, including a separate number sheet secured beneath the top sheet and having the bingo numbers printed on it, said number sheet being of a color different than the color of the top sheet.

12. The bingo card defined in claim 11, including a separate intermediate sheet of hard and tough plastic material secured beneath the separate slides and above the bingo numbers.

* * * * *